US009239532B2

(12) United States Patent
Hirai et al.

(10) Patent No.: US 9,239,532 B2
(45) Date of Patent: Jan. 19, 2016

(54) BRILLIANT TONER, ELECTROSTATIC CHARGE IMAGE DEVELOPER, AND TONER CARTRIDGE

(71) Applicant: FUJI XEROX CO., LTD., Tokyo (JP)

(72) Inventors: Sakiko Hirai, Kanagawa (JP); Atsushi Sugitate, Kanagawa (JP); Masaru Takahashi, Kanagawa (JP); Makoto Kamisaki, Kanagawa (JP); Satomi Hara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 37 days.

(21) Appl. No.: 14/180,870

(22) Filed: Feb. 14, 2014

(65) Prior Publication Data

US 2015/0064615 A1 Mar. 5, 2015

(30) Foreign Application Priority Data

Sep. 5, 2013 (JP) ..... 2013-184266

(51) Int. Cl.

| | |
|---|---|
| ***G03G 9/09*** | (2006.01) |
| ***G03G 9/087*** | (2006.01) |
| ***G03G 9/08*** | (2006.01) |

(52) U.S. Cl.

CPC ..... *G03G 9/0902* (2013.01); *G03G 9/0819* (2013.01); *G03G 9/0821* (2013.01); *G03G 9/0827* (2013.01); *G03G 9/08755* (2013.01); *G03G 9/08795* (2013.01); *G03G 9/08797* (2013.01); *G03G 9/0926* (2013.01)

(58) Field of Classification Search

CPC ..... G03G 9/0902; G03G 9/08755; G03G 9/0821; G03G 9/0926; G03G 9/0827; G03G 9/0819

USPC ..... 430/108.1, 110.1, 110.3, 111.4

See application file for complete search history.

(56) References Cited

U.S. PATENT DOCUMENTS

| | | | | |
|---|---|---|---|---|
| 6,783,584 | B2 * | 8/2004 | Takahashi | 106/403 |
| 7,300,736 | B2 * | 11/2007 | Fushimi et al. | 430/109.4 |
| 7,955,772 | B2 * | 6/2011 | Schuster et al. | 430/108.1 |
| 2002/0048010 | A1 | 4/2002 | Inaba et al. | |
| 2011/0223385 | A1 * | 9/2011 | Shiao et al. | 428/144 |
| 2011/0318683 | A1 * | 12/2011 | Kadokura et al. | 430/105 |
| 2012/0237868 | A1 * | 9/2012 | Yamada et al. | 430/105 |
| 2012/0264041 | A1 * | 10/2012 | Yamasaki et al. | 430/105 |
| 2013/0078562 | A1 | 3/2013 | Takahashi et al. | |
| 2013/0143151 | A1 | 6/2013 | Nakashima et al. | |
| 2013/0323633 | A1 | 12/2013 | Takahashi et al. | |
| 2014/0050768 | A1 * | 2/2014 | Struck et al. | 424/401 |

FOREIGN PATENT DOCUMENTS

| | | |
|---|---|---|
| JP | A-09-160298 | 6/1997 |
| JP | A-2002-108019 | 4/2002 |
| JP | A-2003-012964 | 1/2003 |

(Continued)

OTHER PUBLICATIONS

ECKART GmbH Technical Product Information Sheet No. 00011.1, edition Jun. 2007, describing the product "LITHOFLEX XA 40 01 rich gold.".*

*Primary Examiner* — Janis L Dote

(74) *Attorney, Agent, or Firm* — Oliff PLC

(57) ABSTRACT

A brilliant toner contains a metallic pigment and a binder resin, and content of Zn is from 0.00005% by weight to 1.0% by weight.

17 Claims, 3 Drawing Sheets

(56) References Cited

FOREIGN PATENT DOCUMENTS

| | | |
|---|---|---|
| JP | A-2005-134738 | 5/2005 |
| JP | A-2010-256613 | 11/2010 |
| JP | A-2012-32764 | 2/2012 |
| JP | A-2012-042624 | 3/2012 |
| JP | A-2013-73017 | 4/2013 |
| JP | A-2013-117697 | 6/2013 |
| JP | A-2013-134314 | 7/2013 |
| JP | A-2013-250324 | 12/2013 |
| WO | WO-2012/130680 A1 * | 10/2012 |

* cited by examiner

BRILLIANT TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2013-184266 filed Sep. 5, 2013.

BACKGROUND

1. Technical Field

The present invention relates to a brilliant toner, an electrostatic charge image developer, and a toner cartridge.

2. Related Art

Brilliant toners are used for the purpose of forming an image having brilliance such as metallic luster.

SUMMARY

According to an aspect of the invention, there is provided a brilliant toner including a metallic pigment and a binder resin, wherein content of Zn is from 0.00005% by weight to 1.0% by weight.

BRIEF DESCRIPTION OF THE DRAWINGS

Exemplary embodiments of the present invention will be described in detail based on the following figures, wherein.

DETAILED DESCRIPTION

Hereinafter, exemplary embodiments of a brilliant toner, an electrostatic charge image developer, and a toner cartridge of the invention will be described in detail.

Brilliant Toner

The brilliant toner (hereinafter, referred to as toner according to the exemplary embodiment, in some cases) according to the exemplary embodiment is a toner containing a metallic pigment, in which content of Zn is from 0.00005% by weight to 1.0% by weight.

The "brilliance" in the exemplary embodiment denotes that brilliance such as metallic luster is obtained when visually recognizing an image which is formed by the brilliant toner according to the exemplary embodiment.

By using the toner according to the exemplary embodiment, occurrence of image unevenness over time on a toner image having brilliance is prevented. The reason thereof is not clear, but may be supposed as follows.

Figure 1:
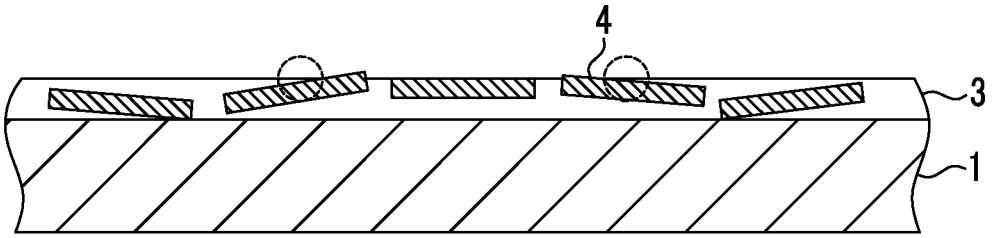
FIG. 1 is a diagram illustrating a fixed state of a brilliant image which is fixed to a surface of a recording medium.

FIG. 1 is a diagram illustrating a fixed state of a brilliant image which is fixed to a surface of a recording medium. In FIG. 1, a brilliant image 3 which is fixed to a surface of a recording medium 1 includes a flake shape metallic pigment 4. The metallic pigment 4 is exposed from a surface of the brilliant image 3, in some cases. The metallic pigment 4 which is exposed from the surface of the brilliant image 3 may be oxidized and discolored due to an effect of moisture or the like in the air. The vicinity (portions surrounded by a dotted line of FIG. 1) to which the metallic pigment 4 is exposed among binder resin configuring the brilliant image 3, is easily hydrolyzed and degraded due to the effect of moisture or the like in the air and the metallic pigment 4, and the portion of the degraded binder resin may be discolored. As a result, the image unevenness over time may occur in the toner image and the brilliance may be degraded.

Since the toner according to the exemplary embodiment contains Zn in a specific range, Zn existing in the toner prevents oxidation of the metallic pigment and hydrolysis of the binder resin existing in the vicinity of the pigment. Accordingly, it is supposed that the occurrence of the image unevenness over time is prevented, and therefore a decrease of the brilliance is prevented.

A content of Zn in the toner according to the exemplary embodiment is from 0.00005% by weight to 1.0% by weight. If the content of Zn exceeds 1.0% by weight, image deletion may occur due to reasons such as occurrence of effusion of ions in high humidity and decrease of a charge amount of the toner. On the other hand, if the content of Zn is less than 0.00005% by weight, the oxidation of the metallic pigment or the degradation of the binder resin may not be prevented by Zn.

The content of Zn in the toner according to the exemplary embodiment is preferably from 0.0001% by weight to 0.5% by weight and more preferably from 0.0005% by weight to 0.1% by weight.

Zn contained in the toner according to the exemplary embodiment may be derived from the metallic pigment, and a component containing Zn may be contained in the toner or may be contained in both of the metallic pigment and the toner.

In the exemplary embodiment, the content of Zn in the toner is a value which is measured by X-ray fluorometry (XRF). Measurement conditions using XRF and a preparing method of a measurement sample will be described later.

In the toner according to the exemplary embodiment, when forming a solid image, it is preferable that a ratio (A/B) of a reflectance A at a light-receiving angle of +30° and a reflectance B at a light-receiving angle of −30° which are measured when incident light at an angle of incidence of −45° is radiated with respect to the solid image by using a goniophotometer, be from 2 to 100.

The phenomenon that the ratio (A/B) is 2 or greater indicates that reflection on a side (plus-angle side) opposite to a side (minus-angle side) on which the incident light is radiated is larger than reflection on the side (minus-angle side) on which the incident light is radiated, that is, diffuse reflection of the incident light is prevented. When diffuse reflection in which incident light is reflected in various directions occurs and the reflected light is visually confirmed, colors appear to be dull. Therefore, when the ratio (A/B) is less than 2, even when the reflected light is visually confirmed, the gloss may not be confirmed and the brilliance may become poor.

On the other hand, when the ratio (A/B) is greater than 100, an angle of view at which the reflected light is visible is too narrow and a specular reflection light component is large. As a result, an image may be viewed as a dark image depending on the angle of view. In addition, it is difficult to manufacture a toner having a ratio (A/B) that is greater than 100.

The ratio (A/B) is more preferably from 50 to 100, even more preferably from 60 to 90, and particularly preferably from 70 to 80.

Measurement of Ratio (A/B) by Goniophotometer

First, the angle of incidence and the light-receiving angle will be described. In this exemplary embodiment, the angle of incidence is set to −45° in the measurement by a goniophotometer. This is because high measurement sensitivity is achieved for images having a wide range of glossiness.

In addition, the reason why the light-receiving angle is set to −30° and +30° is that the highest measurement sensitivity is achieved in the evaluation of brilliant images and non-brilliant images.

Next, a method of measuring the ratio (A/B) will be described.

In this exemplary embodiment, in the measurement of the ratio (A/B), first, a "solid image" is formed by the following method. A developing device of a DOCUCENTRE-III C7600 manufactured by Fuji Xerox Co., Ltd. is filled with a developer that is a sample, and a solid image having a toner amount of 4.5 g/cm$^2$ is formed on a recording sheet (OK Top Coat+ paper, manufactured by Oji Paper Co., Ltd.) at a fixing temperature of 190° C. and a fixing pressure of 4.0 kg/cm$^2$. The "solid image" refers to an image having a coverage rate of 100%.

Incident light at an angle of incidence of −45° is radiated on an image part of the formed solid image by using a variable angle photometer GC5000L as a goniophotometer manufactured by Nippon Denshoku Industries Co., Ltd., and a reflectance A at a light-receiving angle of +30° and a reflectance B at a light-receiving angle of −30° are measured. Each of the reflectance A and the reflectance B is measured for light having a wavelength of from 400 nm to 700 nm at intervals of 20 nm, and defined as an average of the reflectances at respective wavelengths. The ratio (A/B) is calculated from these measurement results.

Configuration of Toner

From the viewpoint of satisfying the above-described ratio (A/B), the toner according to this exemplary embodiment preferably satisfies the following requirements (1) and (2).

(1) The toner has an average equivalent circle diameter D longer than an average maximum thickness C.

(2) When cross sections of toner particles in a thickness direction are observed, the number of metallic pigment particles that are present in which an angle between a long axis direction of the toner in the cross section and a long axis direction of the metallic pigment is from −30° to +30° is 60% or greater of the total number of metallic pigment particles that are observed.

Figure 2:
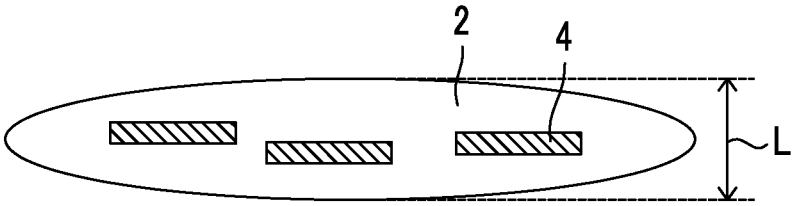
FIG. 2 is a cross-sectional view schematically showing a toner according to the exemplary embodiment.

FIG. 2 shows a cross-sectional view schematically showing a toner satisfying the above-described requirements (1) and (2). The schematic view shown in FIG. 2 is a cross-sectional view of the toner in a thickness direction thereof.

A toner 2 shown in FIG. 2 is a flake shape toner having an equivalent circle diameter larger than a thickness L, and contains a metallic pigment 4, each particle having a flake-like shape.

In the case in which the toner 2 has a flake shape in which the equivalent circle diameter is larger than the thickness L as shown in FIG. 2, when the toner is moved to an image holding member, an intermediate transfer member, a recording medium, or the like in a developing step or a transfer step in the image formation, the toner tends to move so as to cancel out the charges of the toner to the maximum extent. Therefore, it is thought that the toner particles are arranged so that the adhering area becomes the maximum. That is, it is thought that the flake shape toner particles are arranged so that the flat surface sides thereof face a surface of a recording medium onto which the toner is finally transferred. In addition, in a fixing step in the image formation, it is thought that the flake shape toner particles are also arranged by the pressure during fixing so that the flat surface sides thereof face the surface of the recording medium.

Therefore, among the flake shape metallic pigment particles contained in the toner, metallic pigment particles that satisfy "an angle between a long axis direction of the toner in the cross section and a long axis direction of the metallic pigment is from −30° to +30°" described in the requirement (2) are thought to be arranged so that the surface side that provides the maximum area faces the surface of the recording medium. It is thought that, when an image formed in this manner is irradiated with light, the proportion of a metallic pigment that causes diffuse reflection of the incident light is prevented, and thus the above-described range of the ratio (A/B) is achieved. In addition, when the proportion of the metallic pigment that causes diffuse reflection of the incident light is prevented, the intensity of the reflected light remarkably varies depending on the angle of view, and thus more ideal brilliance is obtained.

Next, components of the toner according to this exemplary embodiment will be described.

The toner according to this exemplary embodiment is configured to include toner particles, and if necessary, an external additive.

The toner particles are configured to include, for example, a binder resin, a metallic pigment, and if necessary, a release agent and other additives.

Metallic Pigment

As the metallic pigment used in the exemplary embodiment, the following materials are used, for example. Metallic powder such as aluminum, brass, bronze, nickel, or the like is used.

Among these, it is preferable that the metallic pigment used in the exemplary embodiment contain an aluminum (Al) pigment from a viewpoint of availability and ease of flattening.

In a case of containing the aluminum pigment as the metallic pigment, an aluminum pigment containing Zn may be used.

Examples of a method of causing Zn to exist in the metallic pigment include a method of mixing aluminum and a zinc-containing compound, for example, to prepare molten metal, and then manufacturing powder by applying an air-atomizing method using the molten metal, a method of solidifying a melted alloy and then performing mechanical pulverization, and the like.

In addition, as a method of causing zinc to exist particularly on the surface of the metallic pigment, surface treatment may be performed on the metallic pigment by zinc sulfate or the like. In order to further increase an effect of the exemplary embodiment, it is preferable to form a coating film obtained by zinc oxide, on the surface of the metallic pigment.

When the metallic pigment contains Zn, Zn may be coated on the surface of the metallic pigment such as the aluminum pigment, for example. As a method of coating Zn on the surface of the aluminum pigment, the following method is used, for example.

The metallic pigment and 10% by weight zinc sulfate aqueous solution are mixed with each other, and by stirring the mixture for a given time at 25° C., zinc sulfate is attached to the surface of the metallic pigment. After filtering the resultant material, by performing vacuum drying, a metallic pigment which is coated by zinc is obtained.

When the metallic pigment contains Zn, a content of Zn in the metallic pigment is preferably equal to or less than 5% by weight, more preferably from 0.001% by weight to 3% by weight, and even more preferably from 0.005% by weight to 2% by weight. If the content of Zn in the metallic pigment is high, the metallic pigment may show a gray color and the brilliance may be impaired. If the content of Zn in the metallic pigment is equal to or less than 5% by weight, degradation of the brilliance due to existence of Zn is prevented.

The content of Zn in the metallic pigment when the metallic pigment contains Zn, is a value which is measured by X-ray fluorometry (XRF). Measurement conditions using XRF and a preparing method of a measurement sample will be described later.

Content of the metallic pigment in the toner according to the exemplary embodiment is preferably from 1 part by weight to 70 parts by weight and more preferably from 5 parts by weight to 50 parts by weight, with respect to 100 parts by weight of the binder resin which will be described later.

A proportion of the aluminum pigment in the entire metallic pigment is preferably from 40% by weight to 100% by weight, more preferably from 60% by weight to 100% by weight, and even more preferably from 80% by weight to 100% by weight.

Binder Resin

Examples of the binder resin include vinyl-based resins formed of homopolymers of monomers such as styrene compounds (e.g., styrene, p-chlorostyrene, and α-methylstyrene), (meth)acrylates ester compounds (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitrile compounds (e.g., acrylonitrile and methacrylonitrile), vinyl ether compounds (e.g., vinyl methyl ether and vinyl isobutyl ether), vinyl ketone compounds (e.g., vinyl methyl ketone, vinyl ethyl ketone, and vinyl isopropenyl ketone), and olefin compounds (e.g., ethylene, propylene and butadiene), or copolymers obtained by combining two or more kinds of these monomers.

As the binder resin, there are also exemplified non-vinyl-based resins such as epoxy resins, polyester resins, polyurethane resins, polyamide resins, cellulose resins, polyether resins, and modified rosin, mixtures thereof with the above-described vinyl-based resins, or graft polymers obtained by polymerizing a vinyl-based monomer with coexisting such non-vinyl-based resins.

These binder resins may be used singly or in combination of two or more kinds thereof.

A polyester resin is suitable as the binder resin.

As the polyester resin, a known polyester resin is exemplified.

As the polyester resin, a condensation polymer of a polyvalent carboxylic acid and a polyol is exemplified. A commercially available product or a synthesized product may be used as a polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferable as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferable, and aromatic diols are more preferable as the polyol.

As the polyol, a tri- or higher-valent polyol employing a crosslinked structure or a branched structure may be used in combination together with the diol. Examples of the tri- or higher-valent polyol include glycerin, trimethylolpropane, and pentaerythritol.

The polyols may be used singly or in combination of two or more kinds thereof.

The glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K-1987 "Testing methods for transition temperatures of plastics".

The weight average molecular weight (Mw) of the polyester resin is preferably from 5,000 to 1,000,000, and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed using GPC manufactured by Tosoh Corporation, HLC-8120 GPC, as a measuring device column manufactured by Tosoh Corporation, TSK GEL SUPER HM-M column (15 cm), and a THF solvent. The weight average molecular weight and the number average molecular weight are calculated using a molecular weight calibration curve plotted from monodisperse polystyrene standard samples from the results of the above measurement.

A known manufacturing method is used to manufacture the polyester resin. Specific examples thereof include a method of conducting a reaction at a polymerization temperature set to, from 180° C. to 230° C., if necessary, under reduced pressure in the reaction system, while removing water or alcohol that is generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and acid or alcohol to be polycondensed with the monomer may be previously condensed and then polycondensed with the main component.

The content of the binder resin is, for example, preferably from 40% by weight to 95% by weight, more preferably from 50% by weight to 90% by weight, and even more preferably from 60% by weight to 85% by weight with respect to the entire toner particles.

Release Agent

Examples of the release agent include hydrocarbon-based waxes; natural waxes such as carnauba wax, rice wax, and candelilla wax; synthetic or mineral/petroleum-based waxes such as montan wax; and ester-based waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from "melting peak temperature" described in the method of obtaining a melting temperature in JIS K-1987 "Testing methods for transition temperatures of plastics", from a DSC curve obtained by differential scanning calorimetry (DSC).

The content of the release agent is, for example, preferably from 1% by weight to 20% by weight, and more preferably from 5% by weight to 15% by weight with respect to the entire toner particles.

Other Additives

Examples of other additives include known additives such as a magnetic material, a charge-controlling agent, and an inorganic powder. The toner particles include these additives as internal additives.

In the exemplary embodiment, a component containing Zn may be contained in the toner, in addition to the metallic pigment. Examples of the component containing Zn in this case include zinc sulfate, zinc chloride, zinc nitrate, zinc sulfide, and the like.

Characteristics of Toner

Average Maximum Thickness C and Average Equivalent Circle Diameter D

As shown in the requirement (1) the toner according to this exemplary embodiment preferably has an average equivalent circle diameter D larger than an average maximum thickness C. A ratio (C/D) of the average maximum thickness C to the average equivalent circle diameter D is more preferably from 0.001 to 0.500, even more preferably from 0.010 to 0.200, and particularly preferably from 0.050 to 0.100.

When the ratio (C/D) is 0.001 or greater, toner strength is secured and fractures that are caused due to a stress in the image formation are thus prevented, whereby a reduction in charges that is caused by exposure of the pigment, and fogging that is caused as a result thereof are prevented. On the other hand, when the ratio (C/D) is 0.500 or less, excellent brilliance is obtained.

The average maximum thickness C and the average equivalent circle diameter D are measured by the following method.

A toner is placed on a smooth surface and uniformly dispersed by applying vibrations. 1,000 toner particles are observed with a color laser microscope "VK-9700" (manufactured by Keyence Corporation) at a magnification of 1,000 times to measure a maximum thickness C and an equivalent circle diameter D of a surface viewed from the top, and arithmetic averages thereof are obtained to calculate the average maximum thickness C and the average equivalent circle diameter D.

Angle between Long Axis Direction of Toner in Cross Section and Long Axis Direction of Metallic Pigment As shown in the requirement (2), when cross sections of toner particles in a thickness direction are observed, the number of metallic pigment particles that are present in which an angle between a long axis direction of the toner in the cross section and a long axis direction of the metallic pigment is from −30° to +30° is preferably 60% or greater of the total number of metallic pigment particles that are observed. Furthermore, the number is more preferably from 70% to 95%, and particularly preferably from 80% to 90% of the total number of metallic pigment particles.

When the above number is 60% or greater of the total number of metallic pigment particles, excellent brilliance is obtained.

Herein, the observation method of the cross sections of toner will be described.

Toner is embedded using a bisphenol A type liquid epoxy resin and a hardening agent, and then a cutting sample is prepared. Then, the cutting sample is cut by using a cutter using a diamond knife (using LEICA ULTRAMICROTOME (manufactured by Hitachi High-Technologies Corporation) in the exemplary embodiment) at −100° C., and an observation sample is prepared. With this observation sample, the cross sections of the toner are observed using a transmission electron microscope (TEM) at a magnification of about 5000 times. With the 1000 observed toner particles, the number of metallic pigments in which the angle between the long axis direction of the toner in cross section and the long axis direction of the metallic pigment is from −30° C. to +30° C., is counted using image analysis software, and the proportion thereof is calculated.

The "long axis direction of the toner in the cross section" indicates a direction perpendicular to the thickness direction of the toner having the average equivalent circle diameter D larger than the average maximum thickness C. The "long axis direction of the metallic pigment" indicates a length direction of the metallic pigment.

The volume average particle size of the toner according to this exemplary embodiment is preferably from 1 μm to 30 μm and more preferably from 3 μM to 20 μm.

Regarding the volume average particle size $D_{50v}$, cumulative distributions by volume and by number are drawn from the side of the smallest diameter on the basis of particle size ranges (channels) separated based on the particle size distribution measured by a measuring instrument such as a MULTISIZER II (manufactured by Beckman Coulter Inc.). The particle diameter when the cumulative percentage becomes 16% is defined as that corresponding to a volume $D_{16v}$ and a number $D_{16p}$. The particle diameter when the cumulative percentage becomes 50% is defined as that corresponding to a volume $D_{50v}$ and a number $D_{50p}$, and the particle diameter when the cumulative percentage becomes 84% is defined as that corresponding to a volume $D_{84v}$ and a number $D_{84p}$. Using these, a volume average particle size distribution index (GSDv) is calculated as $(D_{84v}/D_{16v})^{1/2}$.

The toner according to this exemplary embodiment may be prepared by adding an external additive to toner particles after manufacturing of the toner particles.

The method of manufacturing toner particles is not particularly limited, and toner particles are prepared by a known method such as a dry method, e.g., a kneading and pulverizing method or a wet method, e.g., an emulsion aggregating method and a dissolution and suspension method.

The kneading and pulverizing method is a method of mixing each material such as the metallic pigment and the like and then melting and kneading the material using a kneader, an extruder or the like, performing coarse pulverizing of the obtained melted and kneaded material, and then performing pulverization using a jet mill or the like, and obtaining toner particles having a particle diameter in a target range by a wind classifier.

In more detail, the kneading and pulverizing method is divided into a kneading step of kneading a toner forming material including the metallic pigment and the binder resin, and a pulverization step of pulverizing the kneaded material. If necessary, the method may include another step such as a cooling step of cooling the kneaded material formed by the kneading step.

Each step according to the kneading and pulverizing method will be described in detail.

Kneading Step

In the kneading step, the toner forming material including the metallic pigment and the binder resin is kneaded.

In the kneading step, it is preferable to add 0.5 part by weight to 5 parts by weight of an aqueous medium (for example, water such as distilled water or ion exchange water, alcohols, or the like) with respect to 100 parts by weight of the toner forming material.

Examples of a kneading machine used in the kneading step include a single-screw extruder, a twin-screw extruder, and the like. Hereinafter, a kneading machine including a sending screw portion and two kneading portions will be described as an example of the kneading machine with reference to the drawing, but it is not limited thereto.

Figure 3:
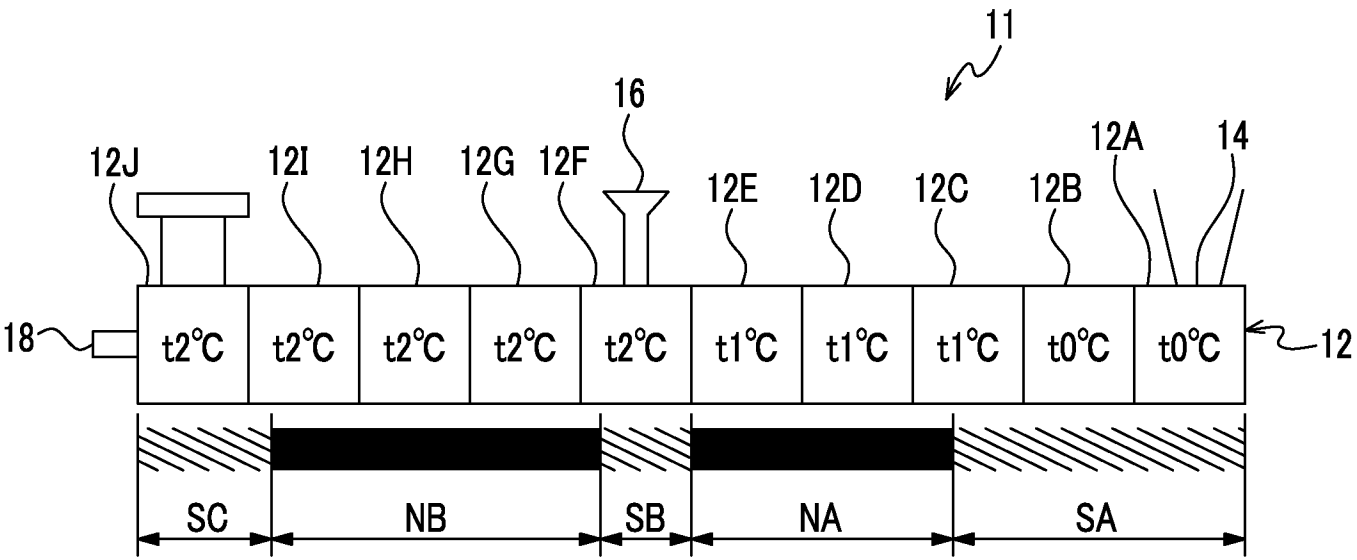
FIG. 3 is a diagram illustrating a screw state of an example of a screw extruder that is used when manufacturing the toner according to the exemplary embodiment.

FIG. 3 is a diagram illustrating a screw state of an example of a screw extruder that is used in the kneading step of the method of manufacturing the toner according to this exemplary embodiment.

A screw extruder 11 is constituted by a barrel 12 provided with a screw (not shown), an injection port 14 through which a toner forming material that is a raw material of the toner is injected to the barrel 12, a liquid addition port 16 for adding an aqueous medium to the toner forming material in the barrel 12, and a discharge port 18 through which the kneaded material formed by kneading the toner forming material in the barrel 12 is discharged.

In order from a portion close to the injection port 14, the barrel 12 is divided into a sending screw portion SA which transports the toner forming material which is injected from the injection port 14 to a kneading portion NA, the kneading portion NA for melting and kneading the toner forming material by a first kneading step, a sending screw portion SB which transports the toner forming material which is melted and kneaded in the kneading portion NA to a kneading portion NB, the kneading portion NB which is for melting and kneading the toner forming material by a second kneading step to form a kneaded material, and a sending screw portion SC which transports the formed kneaded material to the discharge port 18.

In addition, in the barrel 12, a different temperature controller (not shown) is provided for each block. That is, the temperatures of blocks 12A to 12J may be controlled to be different from each other. FIG. 3 shows a state in which the temperatures of the blocks 12A and 12B are controlled to t0° C., the temperatures of the blocks 12C to 12E are controlled to t1° C., and the temperatures of the blocks 12F to 12J are controlled to t2° C. Therefore, the toner forming material in the kneading portion NA is heated to t1° C., and the toner forming material in the kneading portion NB is heated to t2° C.

When the toner forming material containing a binder resin, a metallic pigment, and if necessary, a release agent and the like is supplied to the barrel 12 from the injection port 14, the sending screw portion SA sends the toner forming material to the kneading portion NA. At this time, since the temperature of the block 12C is set to t1° C., the toner forming material melted by heating is fed to the kneading portion NA. In addition, since the temperatures of the blocks 12D and 12E are also set to t1° C., the toner forming material is melted and kneaded at a temperature of t1° C. in the kneading portion NA. The binder resin and the release agent are melted in the kneading portion NA and subjected to shear by the screw.

Next, the toner forming material kneaded in the kneading portion NA is sent to the kneading portion NB by the sending screw portion SB.

In the sending screw portion SB, an aqueous medium is added to the toner forming material by injecting the aqueous medium to the barrel 12 from the liquid addition port 16. In FIG. 3, the aqueous medium is injected in the sending screw portion SB, but the invention is not limited thereto. The aqueous medium may be injected in the kneading portion NB, or may be injected in both of the sending screw portion SB and the kneading portion NB. That is, the position at which the aqueous medium is injected and the number of injection positions are selected as necessary.

As described above, due to the injection of the aqueous medium to the barrel 12 from the liquid addition port 16, the toner forming material in the barrel 12 and the aqueous medium are mixed, and the toner forming material is cooled by evaporative latent heat of the aqueous medium, whereby the temperature of the toner forming material is maintained.

Finally, the kneaded material formed by being melted and kneaded by the kneading portion NB is transported to the discharge port 18 by the sending screw portion SC, and is discharged from the discharge port 18.

As described above, the kneading step using the screw extruder 11 shown in FIG. 3 is performed.

Cooling Step

The cooling step is a step of cooling the kneaded material which is formed in the kneading step, and in the cooling step, it is preferable to cool the kneaded material to 40° C. or lower from a temperature of the kneaded material at the time of completing the kneading step, at an average temperature falling rate of 4° C./sec or more. When the cooling rate of the kneaded material is slow, the mixture (mixture of the metallic pigment and, if necessary, internal additives such as a release agent which is internally added in the toner particles) which is finely dispersed in the binder resin in the kneading step may be recrystallized and a dispersion diameter may become large. On the other hand, it is preferable to perform rapid cooling at the average temperature falling rate, since the dispersed state immediately after completion of the kneading step is maintained as it is. The average temperature falling rate is an average value of a rate of the temperature falling from the temperature (for example, t2° C. when using the screw extruder 11 of FIG. 3) of the kneaded material at the time of completing the kneading step to 40° C.

In detail, as a cooling method of the cooling step, a method of using a rolling roll in which cold water or brine is circulated and an insert type cooling belt is used. When performing the cooling using the method described above, a cooling rate thereof is determined by a rate of the rolling roll, a flow rate of the brine, a supplied amount of the kneaded material, a slab thickness at the time of rolling the kneaded material, and the like. The slab thickness is preferably from 1 mm to 3 mm.

Pulverization Step

The kneaded material cooled through the cooling step is pulverized through the pulverization step to form particles. In the pulverization step, for example, a mechanical pulverizer, a jet pulverizer or the like is used.

Classification Step

If necessary, the particles obtained through the pulverization step may be classified through a classification step in order to obtain toner particles having a volume average particle size in a target range. In the classification step, a centrifugal classifier, an inertia-type classifier or the like, that have been used in the past, is used, and fine particles (particles having a particle diameter smaller than the target range) and coarse particles (particles having a particle diameter larger than the target range) are removed.

External Addition Step

For charging adjustment, endowment of fluidity, endowment of charge exchangeability, and the like, inorganic particles represented by silica, titania and aluminum oxide may be added and attached to the obtained toner particles. This is performed by, for example, a V-blender, a HENSCHEL mixer, a Loedige mixer or the like, and the attachment is performed in stages. The amount of the external additive to be added is preferably from 0.1 part by weight to 5 parts by weight, and more preferably from 0.3 part by weight to 2 parts by weight with respect to 100 parts by weight of toner particles.

Classification Step

If necessary, a classification step may be provided after the above-described external addition step. Specifically, as a sieving method, for example, a gyro shifter, a vibrating sieving machine, a wind classifier or the like is used. Through sieving, coarse particles of the external additive and the like are removed, and thus the generation of streaks on the photoreceptor and trickling down contamination in the apparatus are prevented.

In this exemplary embodiment, an emulsion aggregating method may be used in which the shape and the particle diameter of toner particles are easily controlled and the control range in the structure of toner particles such as a core-shell structure is also wide. Hereinafter, a method of manufacturing toner particles using an emulsion aggregating method will be described in detail.

The emulsion aggregating method according to this exemplary embodiment has an emulsification step of forming resin particles (emulsified particles) or the like by emulsifying raw materials of the toner particles, an aggregating step of forming aggregates of the resin particles, and a coalescence step of coalescing the aggregates.

Emulsification Step

A resin particle dispersion may be prepared using a general polymerization method such as an emulsion polymerization method, a suspension polymerization method, or a dispersion polymerization method. Otherwise, a resin particle dispersion may be prepared through emulsification by applying a shear force to a solution obtained by mixing an aqueous medium with a binder resin using a dispersing machine. In this case, particles may be formed by reducing the viscosity of the resin component by heating. In addition, a dispersant may be used in order to stabilize the dispersed resin particles. Furthermore, when a resin is dissolved in an oily solvent having a relatively low solubility to water, the resin is dissolved in the solvent so that particles thereof are dispersed in the water together with a dispersant or a polyelectrolyte, and then heating or decompression is performed to evaporate the solvent, thereby preparing a resin particle dispersion.

Examples of the aqueous medium include water such as distilled water and ion exchange water; and alcohols. Water is preferably used.

Examples of the dispersant that is used in the emulsification step include water-soluble polymers such as polyvinyl alcohol, methyl cellulose, ethyl cellulose, hydroxyethyl cellulose, carboxymethyl cellulose, sodium polyacrylate, and sodium polymethacrylate; surfactants such as anionic surfactants, e.g., sodium dodecylbenzenesulfonate, sodium octadecylsulfate, sodium oleate, sodium laurate, and potassium stearate, cationic surfactants, e.g., laurylamine acetate, stearyl amine acetate, and lauryl trimethyl ammonium chloride, zwitterionic surfactants, e.g., lauryl dimethyl amine oxide, and nonionic surfactants, e.g., polyoxyethylene alkyl ether, polyoxyethylene alkyl phenyl ether, and polyoxyethylene alkylamine; and inorganic salts such as tricalcium phosphate, aluminum hydroxide, calcium sulfate, calcium carbonate, and barium carbonate.

Examples of the dispersing machine that is used in the preparation of the emulsified liquid include a homogenizer, a homomixer, a pressure kneader, an extruder, and a media-dispersing machine. The size of the resin particles is preferably 1.0 μm or less, more preferably from 60 nm to 300 nm, and even more preferably from 150 nm to 250 nm in terms of the average particle diameter (volume average particle size). When the size is 60 nm or greater, the resin particles easily become unstable in the dispersion, and thus the resin particles may easily aggregate. When the size is 1.0 μm or less, the particle diameter distribution of the toner may be narrowed.

In the preparation of a release agent dispersion, a release agent is dispersed in water, together with an ionic surfactant or a polyelectrolyte such as a polymer acid or a polymer base, and then a dispersion treatment is performed using a homogenizer or a pressure discharge-type dispersing machine with which a strong shear force is applied thereto, simultaneously with heating to a temperature that is not lower than the melting temperature of the release agent. A release agent dispersion is obtained through such a treatment. In the dispersion treatment, an inorganic compound such as polyaluminum chloride may be added to the dispersion. Examples of the preferable inorganic compound include polyaluminum chloride, aluminum sulfate, highly basic polyaluminum chloride (BAC), polyaluminum hydroxide, and aluminum chloride. Among these, polyaluminum chloride, aluminum sulfate, and the like are preferable.

Through the dispersion treatment, a release agent dispersion containing release agent particles having a volume average particle size of 1 μm or less is obtained. More preferably, the volume average particle size of the release agent particles is from 100 nm to 500 nm.

When the volume average particle size is 100 nm or greater, the characteristics of the binder resin to be used are also affected, but generally, the release agent component is easily incorporated in the toner. When the volume average particle size is 500 nm or less, the release agent in the toner has a superior dispersion state.

In order to prepare a metallic pigment dispersion, a known dispersion method may be used and a general dispersion unit such as a rotary shearing-type homogenizer, a ball mill having media, a sand mill, a Dyno mill, or an ULTIMIZER may be employed, but there are no limits to the dispersion unit. The metallic pigment is dispersed in water, together with an ionic surfactant or a polyelectrolyte such as a polymer acid or a polymer base. The volume average particle size of the dispersed metallic pigment may be 20 μm or less. The volume average particle size is preferably from 3 μm to 16 μm, since the metallic pigment is dispersed well in the toner with no impairment in aggregability.

In addition, a metallic pigment and a binder resin may be dispersed and dissolved to be mixed with each other in a solvent, and dispersed in the water by phase inversion emulsification or shearing emulsification, thereby preparing a dispersion of metallic pigment particles coated with the binder resin.

Aggregating Step

In the aggregating step, a resin particle dispersion, a metallic pigment dispersion, a release agent dispersion, and the like are mixed to prepare a mixture, and heated to a temperature that is not higher than the glass transition temperature of the resin particles to aggregate the resin particles, thereby forming aggregated particles. In many cases, in order to form the aggregated particles, the pH of the mixture is adjusted to acidic under stirring. By virtue of the above stirring conditions, the ratio (C/D) may be adjusted in a preferable range. More specifically, in the aggregated particle forming stage, when rapid stirring and heating are performed, the ratio (C/D) may be reduced, and when the stirring speed is reduced and the heating is performed at lower temperature, the ratio (C/D) may be increased. The pH is preferably from 2 to 7, at which an aggregating agent may also be effectively used.

Furthermore, in the aggregating step, the release agent dispersion may be added and mixed together with various dispersions such as a resin particle dispersion at once or at several times.

As the aggregating agent, a di- or higher-valent metal complex is preferably used, as well as a surfactant having an opposite polarity to the polarity of the surfactant that is used as the dispersant, and an inorganic metal salt. Since the amount of the surfactant to be used may be reduced and the charging characteristics are improved, a metal complex is particularly preferably used.

As the inorganic metal salt, aluminum salts and polymers thereof are particularly preferable. In order to obtain a narrower particle size distribution, the valence of the inorganic metal salt is more preferably divalent than monovalent, trivalent than divalent, or tetravalent than trivalent, and further, in the case of the same valences as each other, a polymer-type inorganic metal salt polymer is more suitable.

In this exemplary embodiment, a polymer of tetravalent inorganic metal salt including aluminum is preferably used to obtain a narrow particle size distribution.

In addition, when the aggregated particles have a desired particle diameter, the resin particle dispersion may be further added (coating step) to prepare a toner having a configuration in which a surface of a core aggregated particle is coated with a resin. In this case, the release agent or the metallic pigment is not easily exposed to the toner surface, and thus the configuration is preferable from the viewpoint of charging properties or developability. In the case of further addition, an aggregating agent may be added or the pH may be adjusted before further addition.

Coalescence Step

In the coalescence step, the progression of the aggregation is stopped by increasing the pH of the suspension of the aggregated particles to, from 3 to 9 under stirring conditions based on the aggregating step, and the aggregated particles are coalesced by heating at a temperature that is not lower than the glass transition temperature of the resin.

In addition, in the case of coating with the resin, the resin is also coalesced and the core aggregated particles are coated therewith. Regarding the heating time, the heating may be performed to the extent that the coalescence is caused, and may be performed for, approximately, from 0.5 hour to 10 hours.

After coalescence, cooling is performed to obtain coalesced particles. In addition, in the cooling step, crystallization may be promoted by lowering the cooling rate at around the glass transition temperature of the resin (glass transition temperature±10° C.), that is, so-called slow cooling.

The coalesced particles obtained by coalescence are subjected to a solid-liquid separation step such as filtration, and if necessary, a washing step and a drying step, and thus toner particles are obtained.

For charging adjustment, endowment of fluidity, endowment of charge exchangeability, and the like, an inorganic oxide as an external additive represented by silica, titania and aluminum oxide is added and attached to the obtained toner particles. A preferable external addition method and a preferable amount of the external additive to be added are as described above.

As well as the above-described inorganic oxide, other components (particles) such as a charge-controlling agent, organic particles, a lubricant, and an abrasive may be added as external additives.

The charge-controlling agent is not particularly limited, but is preferably colorless or light-colored. Examples thereof include a complex of a quaternary ammonium salt compound, a nigrosine-based compound, aluminum, or chromium, and a triphenylmethane-based pigment.

Examples of the organic particles include particles that are generally used as an external additive for the toner surface, such as a vinyl-based resin, a polyester resin, and a silicone resin. These inorganic or organic particles are used as a fluidity aid, and a cleaning aid, and the like.

Examples of the lubricant include fatty acid amides such as ethylene bis stearic acid amide and oleic acid amide, and fatty acid metal salts such as zinc stearate and calcium stearate.

Examples of the abrasive include silica described above, alumina, and cerium oxide.

Next, a method of manufacturing toner particles using a dissolution and suspension method will be described in detail.

The dissolution and suspension method is a method of obtaining toner particles including: subjecting a liquid in which a material containing a binder resin, a metallic pigment, and other optional components such as a release agent is dissolved or dispersed in a solvent in which the binder resin is soluble to granulation in an inorganic dispersant-containing aqueous medium; and removing the solvent.

Examples of other components that are used in the dissolution and suspension method include various components such as a charge-controlling agent and organic particles, as well as a release agent.

In this exemplary embodiment, the binder resin, the metallic pigment, and other optional components are dissolved and dispersed in a solvent in which the binder resin is soluble. Whether the binder resin is soluble or not depends on the constituent component of the binder resin, a molecular chain length, a level of three-dimensionalization, and the like, and thus although it may not be said with certainty, hydrocarbons such as toluene, xylene and hexane, halogenated hydrocarbons such as methylene chloride, chloroform, dichloroethane, and dichloroethylene, alcohols or ethers such as ethanol, butanol, benzyl alcohol ethyl ether, benzyl alcohol isopropyl ether, tetrahydrofuran, and tetrahydropyran, esters such as methyl acetate, ethyl acetate, butyl acetate, and isopropyl acetate, and ketones or acetals such as acetone, methyl ethyl ketone, diisobutyl ketone, dimethyl oxide, diacetone alcohol, cyclohexanone, and methylcyclohexanone are generally used.

In these solvents, the binder resin is dissolved and it is not necessary to dissolve the metallic pigment and other components. The metallic pigment and other components may be dispersed in the binder resin solution. The amount of the solvent to be used is not limited as long as a viscosity at which granulation may be performed in the aqueous medium is provided. The ratio of the material containing a binder resin, a metallic pigment, and other components (the former) to the solvent (the latter) is preferably from 10/90 to 50/50 (the former/the latter in terms of mass ratio) in view of ease of granulation and final yield of toner particles.

The liquid in which the binder resin, the metallic pigment, and other components are dissolved or dispersed in the solvent (toner mother liquid) is granulated so that particles having a predetermined particle diameter are obtained in the inorganic dispersant-containing aqueous medium. Water is mainly used as the aqueous medium. As the inorganic dispersant, a powder selected from tricalcium phosphate, hydroxyapatite, calcium carbonate, titanium oxide, and silica powders is preferable. The amount of the inorganic dispersant to be used is determined in accordance with the particle diameter of particles to be granulated. Generally, the amount of the inorganic dispersant to be used is preferably from 0.1% by weight to 15% by weight with respect to the toner mother liquid. When the amount is 0.1% by weight or greater, the granulation is favorably performed, and when the amount is 15% by weight or less, unnecessary fine particles are not easily formed, and thus target particles are easily obtained in good yield.

In order to favorably progress the granulation of the toner mother liquid in the inorganic dispersant-containing aqueous medium, an aid may be added to the aqueous medium. Examples of the aid include known cationic, anionic, and nonionic surfactants, and anionic surfactants are particularly preferable. Examples thereof include sodium alkylbenzenesulfonate, α-sodium olefin sulfonate, and sodium alkylsulfonate. These are used in an amount of preferably from $1\times10^{-4}$% by weight to 0.1% by weight with respect to the toner mother liquid.

The granulation of the toner mother liquid in the inorganic dispersant-containing aqueous medium is preferably performed under shearing. The toner mother liquid that is dispersed in the aqueous medium is granulated to have an average particle diameter of preferably 20 μm or less. The average particle diameter is particularly preferably from 3 μm to 15 μm.

There are various dispersing machines as an apparatus provided with a shearing mechanism, and among these, a homogenizer is preferable. Using a homogenizer, a substance in a liquid, that is incompatible with the liquid, is dispersed in the form of particles by passing the substances that are incompatible with each other (in this exemplary embodiment, an inorganic dispersant-containing aqueous medium and a toner mother liquid) through a gap between a casing and a rotating rotor. Examples of the homogenizer include a TK homomixer, a line-flow homomixer, an autohomomixer (all manufactured by Tokushukika Kogyo K.K.), a Silverson homogenizer (manufactured by Silverson Machines, Inc.), and a Polytron homogenizer (manufactured by KINEMATICA AG).

The stirring using the homogenizer is preferably performed under the condition that a peripheral speed of a blade of the rotor is 2 m/sec or higher. When the peripheral speed is 2 m/sec or higher, there is a tendency that particles are formed favorably. In this exemplary embodiment, the toner mother liquid is granulated in the inorganic dispersant-containing aqueous medium, and then the solvent is removed. The solvent may be removed at room temperature (25° C.) under ordinary pressure. However, since a long time is required until the removal, the solvent is preferably removed at a temperature that is lower than the boiling point of the solvent and has a difference from the boiling point of 80° C. or lower. The pressure may be ordinary or reduced. When the pressure is reduced, the pressure is preferably from 20 mmHg to 150 mmHg.

The toner according to this exemplary embodiment is preferably washed with hydrochloric acid or the like after removal of the solvent. Accordingly, the inorganic dispersant remaining on the surfaces of the toner particles is removed, and thus characteristics may be improved with the original composition of the toner particles. When performing dehydration and drying, powdery toner particles may be obtained.

As in the case of the emulsion aggregating method, for charging adjustment, endowment of fluidity, endowment of charge exchangeability, and the like, an inorganic oxide as an external additive represented by silica, titania and aluminum oxide is added and attached to the toner particles obtained by the dissolution and suspension method. As well as the above-described inorganic oxide, other components (particles) such as a charge-controlling agent, organic particles, a lubricant, and an abrasive may be added as external additives.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended into a matrix resin; a resin impregnation-type carrier in which a porous magnetic powder is impregnated with a resin; and a resin dispersion-type carrier in which conductive particles are dispersed and blended into a matrix resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metal such as iron, nickel, cobalt, and the like, and magnetic oxide such as ferrite, magnetite, and the like.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluorine resin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (mass ratio) between the toner and the carrier in the two-component developer is preferably from 1:100 to 30:100 (toner:carrier), and more preferably from 3:100 to 20:100.

Image Forming Apparatus and Image Forming Method

An image forming apparatus and an image forming method according to this exemplary embodiment will be described.

The image forming apparatus according to this exemplary embodiment is provided with an image holding member, a charging section that charges a surface of the image holding member, an electrostatic charge image forming section that forms an electrostatic charge image on the charged surface of the image holding member, a developing section that contains an electrostatic charge image developer and develops the electrostatic charge image formed on the surface of the image holding member with the electrostatic charge image developer to form a toner image, a transfer section that transfers the toner image formed on the surface of the image holding member onto a surface of a recording medium, and a fixing section that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging step of charging a surface of an image holding member, an electrostatic charge image forming step of forming an electrostatic charge image on the charged surface of the image holding member, a developing step of developing the electrostatic charge image formed on the surface of the image holding member with the electrostatic charge image developer according to this exemplary embodiment to form a toner image, a transfer step of transferring the toner image formed on the surface of the image holding member onto a surface of a recording medium, and a fixing step of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning section that cleans, after transfer of a toner image and before charging, a surface of an image holding member; or an apparatus that is provided with an erasing unit that irradiates, after transfer of a toner image and before charging, a surface of an image holding member with erasing light to remove electricity.

In the case of an intermediate transfer-type apparatus, a transfer section is configured to have, for example, an intermediate transfer member having a surface onto which a toner image is to be transferred, a primary transfer section that primarily transfers a toner image formed on a surface of an image holding member onto the surface of the intermediate transfer member, and a secondary transfer section that secondarily transfers the toner image transferred onto the surface of the intermediate transfer member onto a surface of a recording medium.

In the image forming apparatus according to this exemplary embodiment, for example, a part including the developing section may have a cartridge structure (process cartridge) that is detachable from the image forming apparatus. As the process cartridge, for example, a process cartridge that contains the electrostatic charge image developer according to this exemplary embodiment and is provided with a developing section is preferably used.

Hereinafter, an example of the image forming apparatus according to this exemplary embodiment will be shown. However, the image forming apparatus is not limited thereto. Major parts shown in the drawings will be described, but descriptions of other parts will be omitted.

Figure 4:
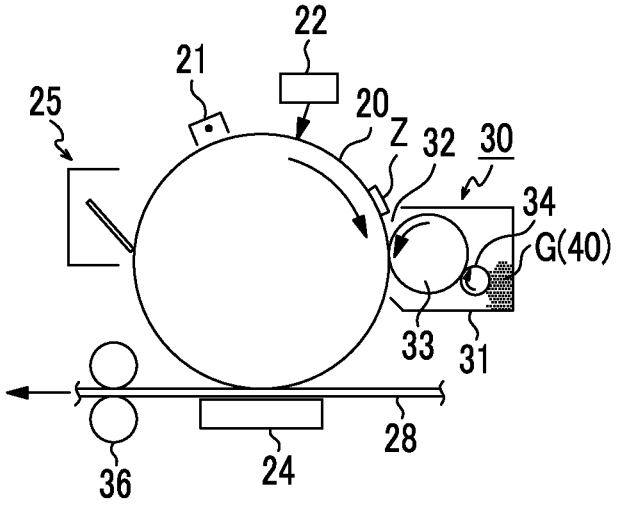
FIG. 4 is a schematic configuration diagram showing an example of an image forming apparatus according to the exemplary embodiment.

FIG. 4 is a schematic configuration diagram showing an example of the image forming apparatus according to the exemplary embodiment which includes a developing device to which an electrostatic charge image developer according to the exemplary embodiment is applied.

In the drawing, the image forming apparatus according to the exemplary embodiment includes a photoreceptor drum 20 as an image holding member which rotates in a predetermined direction, and in the vicinity of this photoreceptor drum 20, a charging device 21 which charges the photoreceptor drum 20, an exposure device 22, for example, as an electrostatic charge image forming device which forms an electrostatic charge image Z on the photoreceptor drum 20, a developing device 30 which visualizes the electrostatic charge image Z formed on the photoreceptor drum 20, a transfer device 24 which transfers a toner image which is visualized on the photoreceptor drum 20 to a recording sheet 28 which is a recording medium, and a cleaning device 25 which cleans off toner remaining on the photoreceptor drum 20 are disposed in order.

In this exemplary embodiment, as shown in FIG. 4, the developing device 30 has a developing housing 31 that contains a developer G including a toner 40. This developing housing 31 has a developing opening 32 formed to be opposed to the photoreceptor drum 20, and a developing roll (developing electrode) 33 as a toner holding member arranged to face the developing opening 32. When a predetermined developing bias is applied to the developing roll 33, a development field is formed in a region (developing region) sandwiched between the photoreceptor drum 20 and the developing roll 33. In the developing housing 31, a charge injection roll (injection electrode) 34 as a charge injection member is provided to be opposed to the developing roll 33. Particularly, in this exemplary embodiment, the charge injection roll 34 also acts as a toner supply roll for supplying the toner 40 to the developing roll 33.

Herein, the charge injection roll 34 may be rotated in an arbitrarily selected direction, but in consideration of supply properties of the toner and charge injection properties, it is preferable that the charge injection roll 34 be rotated in the same direction as that of the developing roll 33 at a part opposed to the developing roll 33 with a difference in the peripheral speed (for example, 1.5 times or greater), and the toner 40 be held in a region sandwiched between the charge injection roll 34 and the developing roll 33 and rubbed to inject charges.

Next, an operation of the image forming apparatus according to the exemplary embodiment will be described.

When an image forming process is started, first, the surface of the photoreceptor drum 20 is charged by the charging device 21, the exposure device 22 records an electrostatic charge image Z on the charged photoreceptor drum 20, and the developing device 30 visualizes the electrostatic charge image Z as a toner image. Then, the toner image on the photoreceptor drum 20 is transported to a transfer site, and the transfer device 24 electrostatically transfers the toner image on the photoreceptor drum 20 onto a recording sheet 28 as a recording medium. The toner remaining on the photoreceptor drum 20 is cleaned off by the cleaning device 25. Thereafter, the toner image on the recording sheet 28 is fixed by a fixing device 36 to obtain an image.

Process Cartridge/Toner Cartridge

A process cartridge according to the exemplary embodiment will be described.

The process cartridge according to the exemplary embodiment is a process cartridge which includes a developing unit which accommodates the electrostatic charge image developer according to the exemplary embodiment and develops an electrostatic charge image formed on a surface of an image holding member as a toner image by the electrostatic charge image developer, and is detachable from the image forming apparatus.

Without being limited to the configuration described above, the process cartridge according to the exemplary embodiment may have a configuration including a developing device and, if necessary, at least one selected from other units such as the image holding member, the charging unit, an electrostatic charge image forming unit, and a transfer unit.

Hereinafter, an example of the process cartridge according to the exemplary embodiment will be shown. However, the process cartridge is not limited thereto. Major parts shown in the drawings will be described, but descriptions of other parts will be omitted.

Figure 5:
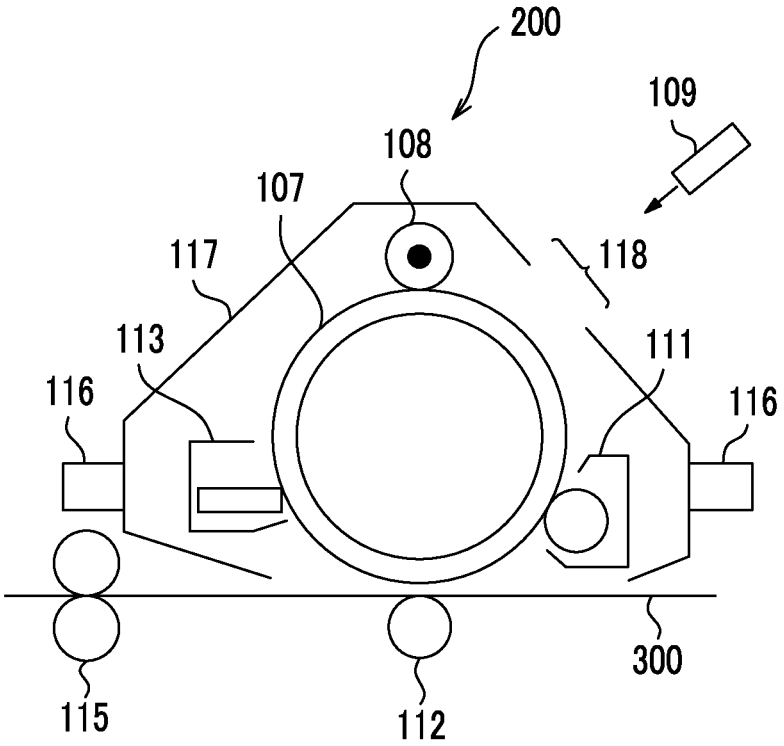
FIG. 5 is a schematic configuration diagram showing an example of a process cartridge according to the exemplary embodiment.

FIG. 5 is a schematic configuration diagram showing the process cartridge according to the exemplary embodiment.

A process cartridge 200 shown in FIG. 5 is, for example, configured by integrally combining and holding a photoreceptor 107 (an example of image holding member), a charging roll 108 (an example of charging unit) which is provided around the photoreceptor 107, a developing device 111 (an example of developing unit), and a photoreceptor cleaning device 113 (an example of cleaning unit) by attachment rails 116 and a housing 117 with an opening portion 118 for exposure, and is configured as a cartridge.

In FIG. 5, reference numeral 109 denotes an exposing device (an example of electrostatic charge image forming unit), reference numeral 112 denotes a transfer device (an example of transfer unit), reference numeral 115 denotes a fixing device (an example of fixing unit), and reference numeral 300 denotes a recording sheet (an example of recording medium).

Next, a toner cartridge according to the exemplary embodiment will be described. The toner cartridge according to the exemplary embodiment may be configured so as to accommodate the brilliant toner according to the exemplary embodiment and to be detachable from the image forming apparatus. At least the toner may be accommodated in the toner cartridge according to the exemplary embodiment, and a developer, for example, may be accommodated therein, depending on a mechanism of the image forming apparatus.

The image forming apparatus shown in FIG. 4 has a configuration in which a toner cartridge (not shown) is detachably mounted thereon, and the developing device 30 is connected to the toner cartridge via a toner supply tube (not shown). In addition, when the toner contained in the toner cartridge runs low, the toner cartridge may be replaced.

EXAMPLES

Hereinafter, the exemplary embodiment will be described in more detail using examples and comparative examples, but is not limited to the following examples. Unless specifically noted, "parts" and "%" are based on weight.

Measurement of Content of Zn in Toner Performed by XRF

A disk having a diameter of 5 cm is prepared by applying a compression pressure of 10 tons to 5 g of a toner by using a pressure molding machine, and is set as a measurement sample. Using an X-ray fluorescence spectrometer (XRF-1500) manufactured by Shimadzu Corporation, the disk is subjected to the measurement under measurement conditions of a tube voltage of 40 KV, a tube current of 90 mA, and a measurement time of 30 minutes.

Measurement of Content of Zn in Metallic Pigment Performed by XRF

By immersing the toner in a solvent such as acetone, methyl ethyl ketone, and dissolving the binder resin, a metallic pigment is obtained. A disk having a diameter of 5 cm is prepared by applying a compression pressure of 10 tons to 5 g of the metallic pigment by using the pressure molding machine, and is set as a measurement sample. Using the X-ray fluorescence spectrometer (XRF-1500) manufactured by Shimadzu Corporation, the disk is subjected to the measurement under measurement conditions of a tube voltage of 40 KV, a tube current of 90 mA, and a measurement time of 30 minutes.

Preparation of Metallic Pigment 1

Aluminum: 99.99973 parts

Zinc: 0.00027 part

The above components are mixed with each other to prepare molten metal, then powder is manufactured by applying the air-atomizing method using the molten metal, and the powder is subjected to classification treatment to obtain a metallic pigment A. A content ratio of Zn in the metallic pigment A is 0.00027%.

Metallic pigment A: 100 parts 0.15% zinc sulfate aqueous solution: 100 parts

The above components are mixed with each other and stirred for 1 minute, and zinc sulfate is attached to the surface of the metallic pigment. After filtering the resultant material, by performing vacuum drying, a metallic pigment 1 which is covered by zinc is obtained. A content ratio of Zn in the metallic pigment 1 is 0.00041%.

Preparation of Metallic Pigment Dispersion 1

Metallic pigment 1: 100 parts

Anionic surfactant (NEOGEN R manufactured by Dai-Ichi Kogyo Seiyaku Co., Ltd.): 1.5 parts Ion exchange water: 400 parts The above components are mixed and dispersed for about 1 hour using an emulsifying dispersing machine CAVITRON (CR1010 manufactured by Pacific Machinery & Engineering Co., Ltd.), and metallic pigment dispersion 1 in which the metallic pigment particles are dispersed (solid content concentration: 20%) is prepared.

Preparation of Metallic Pigment 2 and Metallic Pigment Dispersion 2

A metallic pigment B is obtained in the same method as that of the metallic pigment A, except for setting 99.99967 parts of aluminum and 0.00033 part of zinc. A content ratio of Zn in the metallic pigment B is 0.00033%.

A metallic pigment 2 is obtained in the same method as the preparation of the metallic pigment 1 except for using the metallic pigment B and changing the concentration of 0.15% zinc sulfate aqueous solution in the preparation of the metallic pigment 1 to 0.22%. A content ratio of Zn in the metallic pigment 2 is 0.00055%.

Metallic pigment dispersion 2 is prepared in the same manner as the preparation of the metallic pigment dispersion 1 except for using the metallic pigment 2 instead of the metallic pigment 1.

Preparation of Metallic Pigment Dispersion 3

A metallic pigment 3 is obtained in the same method as that of the preparation of the metallic pigment 1, except for using an aluminum pigment (2173EA manufactured by Showa Aluminum Powder K.K.) and changing the concentration of 0.15% zinc sulfate aqueous solution to 0.1%. A content ratio of Zn in the metallic pigment 3 is 0.00018%.

Metallic pigment dispersion 3 is prepared in the same manner as the preparation of the metallic pigment dispersion 1 except for using the metallic pigment 3 instead of the metallic pigment 1.

Preparation of Metallic Pigment 4 and Metallic Pigment Dispersion 4

A metallic pigment 4 is obtained in the same method as the preparation of the metallic pigment 3, except for changing the concentration of 0.1% zinc sulfate aqueous solution in the preparation of the metallic pigment 3 to 0.15%. A content ratio of Zn in the metallic pigment 4 is 0.00028%.

Metallic pigment dispersion 4 is prepared in the same manner as the preparation of the metallic pigment dispersion 1 except for using the metallic pigment 4 instead of the metallic pigment 1.

Preparation of Metallic Pigment 5 and Metallic Pigment Dispersion 5

A metallic pigment C is obtained in the same method as that of the metallic pigment A, except for setting 99.9983 parts of aluminum and 0.0017 part of zinc in the preparation of the metallic pigment. A content ratio of Zn in the metallic pigment C is 0.00174%.

A metallic pigment 5 is obtained in the same method as the preparation of the metallic pigment 1 except for changing the metallic pigment A in the preparation of the metallic pigment 1 to the metallic pigment C and the concentration of 0.15% zinc sulfate aqueous solution in the preparation of the metallic pigment 1 to 0.42%. A content ratio of Zn in the metallic pigment 5 is 0.00216%.

Metallic pigment dispersion 5 is prepared in the same manner as the preparation of the metallic pigment dispersion 1 except for using the metallic pigment 5 instead of the metallic pigment 1.

Preparation of Metallic Pigment 6 and Metallic Pigment Dispersion 6

A metallic pigment D is obtained in the same method as that of the metallic pigment A, except for setting 99.9981 parts of aluminum and 0.0019 part of zinc in the preparation of the metallic pigment. A content ratio of Zn in the metallic pigment D is 0.00185%.

A metallic pigment 6 is obtained in the same method as the preparation of the metallic pigment 1 except for changing the metallic pigment A in the preparation of the metallic pigment 1 to the metallic pigment D and the concentration of 0.15% zinc sulfate aqueous solution in the preparation of the metallic pigment 1 to 0.54%. A content ratio of Zn in the metallic pigment 6 is 0.00239%.

Metallic pigment dispersion 6 is prepared in the same manner as the preparation of the metallic pigment dispersion 1 except for using the metallic pigment 6 instead of the metallic pigment 1.

Preparation of Metallic Pigment 7 and Metallic Pigment Dispersion 7

A metallic pigment E is obtained in the same method as that of the metallic pigment 1, except for setting 99.65 parts of aluminum and 0.35 part of zinc in the preparation of the metallic pigment. A content ratio of Zn in the metallic pigment E is 0.35%.

A metallic pigment 7 is obtained in the same method as the preparation of the metallic pigment 1 except for changing the metallic pigment A in the preparation of the metallic pigment 1 to the metallic pigment E and the concentration and amount of 100 parts of 0.15% zinc sulfate aqueous solution in the preparation of the metallic pigment 1 to 8.89% and 1000 parts. A content ratio of Zn in the metallic pigment 7 is 0.442%.

Metallic pigment dispersion 7 is prepared in the same manner as the preparation of the metallic pigment dispersion 1 except for using the metallic pigment 7 instead of the metallic pigment 1.

Preparation of Metallic Pigment 8 and Metallic Pigment Dispersion 8

A metallic pigment F is obtained in the same method as that of the metallic pigment 1, except for setting 99.62 parts of aluminum and 0.38 part of zinc in the preparation of the metallic pigment. A content ratio of Zn in the metallic pigment F is 0.38%.

A metallic pigment 8 is obtained in the same method as the preparation of the metallic pigment 1 except for changing the metallic pigment A in the preparation of the metallic pigment 1 to the metallic pigment F and the concentration and amount of 100 parts of 0.15% zinc sulfate aqueous solution in the preparation of the metallic pigment 1 to 12.3% and 1000 parts. A content ratio of Zn in the metallic pigment 8 is 0.506%.

Metallic pigment dispersion 8 is prepared in the same manner as the preparation of the metallic pigment dispersion 1 except for using the metallic pigment 8 instead of the metallic pigment 1.

Preparation of Metallic Pigment 9 and Metallic Pigment Dispersion 9

A metallic pigment G is obtained in the same method as that of the metallic pigment A, except for setting 97.87 parts of aluminum and 2.13 parts of zinc in the preparation of the metallic pigment. A content ratio of Zn in the metallic pigment G is 2.13%.

A metallic pigment 9 is obtained in the same method as the preparation of the metallic pigment 1 except for changing the metallic pigment A in the preparation of the metallic pigment 1 to the metallic pigment G and the concentration and amount of 100 parts of 0.15% zinc sulfate aqueous solution in the preparation of the metallic pigment 1 to 7.4% and 1000 parts. A content ratio of Zn in the metallic pigment 9 is 2.21%.

Metallic pigment dispersion 9 is prepared in the same manner as the preparation of the metallic pigment dispersion 1 except for using the metallic pigment 9 instead of the metallic pigment 1.

Preparation of Metallic Pigment 10 and Metallic Pigment Dispersion 10

A metallic pigment H is obtained in the same method as that of the metallic pigment A, except for setting 97.78 parts of aluminum and 2.22 parts of zinc in the preparation of the metallic pigment. A content ratio of Zn in the metallic pigment H is 2.22%.

A metallic pigment 10 is obtained in the same method as the preparation of the metallic pigment 1 except for changing the metallic pigment A in the preparation of the metallic pigment 1 to the metallic pigment H and the concentration and amount of 100 parts of 0.15% zinc sulfate aqueous solution in the preparation of the metallic pigment 1 to 17.3% and 1000 parts. A content ratio of Zn in the metallic pigment 10 is 2.39%.

Metallic pigment dispersion 10 is prepared in the same manner as the preparation of the metallic pigment dispersion 1 except for using the metallic pigment 10 instead of the metallic pigment 1.

Preparation of Metallic Pigment 11 and Metallic Pigment Dispersion 11

A metallic pigment J is obtained in the same method as that of the metallic pigment A, except for setting 95.71 parts of aluminum and 4.29 parts of zinc in the preparation of the metallic pigment. A content ratio of Zn in the metallic pigment J is 4.29%.

A metallic pigment 11 is obtained in the same method as the preparation of the metallic pigment 1 except for changing the metallic pigment A in the preparation of the metallic pigment 1 to the metallic pigment J and the concentration and amount of 100 parts of 0.15% zinc sulfate aqueous solution in the preparation of the metallic pigment 1 to 17.3% and 1000 parts. A content ratio of Zn in the metallic pigment 11 is 4.46%.

Metallic pigment dispersion 11 is prepared in the same manner as the preparation of the metallic pigment dispersion 1 except for using the metallic pigment 11 instead of the metallic pigment 1.

Preparation of Metallic Pigment 12 and Metallic Pigment Dispersion 12

A metallic pigment K is obtained in the same method as that of the metallic pigment A, except for setting 94.9 parts of aluminum and 5.1 parts of zinc in the preparation of the metallic pigment. A content ratio of Zn in the metallic pigment K is 5.1%.

Metallic pigment dispersion 12 is prepared in the same manner as the preparation of the metallic pigment dispersion 1 except for using the metallic pigment K instead of the metallic pigment 1.

Synthesis of Binder Resin

Dimethyl adipate: 74 parts

Dimethyl terephthalate: 192 parts

Bisphenol A ethylene oxide adduct: 216 parts

Ethylene glycol: 38 parts

Tetrabutoxytitanate (catalyst): 0.037 part

The above components are put in a two-necked flask which is dried by heating, nitrogen gas is introduced in a container to maintain an inert atmosphere, and the components are heated while stirring, and then are subjected to co-condensation polymerization reaction for 7 hours at 160° C., and then a temperature thereof is increased to 220° C. while gradually reducing pressure thereof to 10 Torr and those are maintained for 4 hours. The pressure is temporarily returned to normal pressure, 9 parts of trimellitic anhydride is added, and the pressure thereof is gradually reduced again to 10 Torr and maintained for 1 hour at 220° C., to synthesize the binder resin.

The glass transition temperature (Tg) of the binder resin is acquired by measuring under the conditions of a temperature rising rate of 10° C./min from room temperature (25° C.) to 150° C., using a differential scanning calorimeter (DSC-50 manufactured by Shimadzu Corporation), based on ASTMD 3418-8. The glass transition temperature is set to a temperature at intersection of extended lines of a base line and a rising line in an endothermic portion. The glass transition temperature of the binder resin is 63.5° C.

Preparation of resin particle dispersion

Binder resin: 160 parts

Ethyl acetate: 233 parts

Sodium hydroxide aqueous solution (0.3 N): 0.1 part

The above components are put in a 1000 ml separable flask, heated at 70° C., and stirred with a THREE-ONE-MOTOR (manufactured by Shinto Scientific Co., Ltd.) to prepare resin mixed liquid. The resin mixed liquid is further stirred at 90 rpm, 373 parts of the ion exchange water is gradually added therein to perform phase inversion emulsification, and the solvent thereof is removed to obtain a resin particle dispersion (solid content concentration: 30%). A volume average particle size of the resin particle dispersion is 162 nm.

Preparation of Release Agent Dispersion

Carnauba wax (RC-160 manufactured by Toa Kasei Co., Ltd.): 50 parts

Anionic surfactant (NEOGEN RK manufactured by Dai-Ichi Kogyo Seiyaku Co., Ltd.): 1.0 part Ion exchange water: 200 parts The above components are mixed with each other and heated to 95° C., dispersed using a homogenizer (ULTRA-TURRAX T50 manufactured by IKA Ltd.), and then are subject to dispersion treatment with a MANTON-GAULIN high pressure homogenizer (manufactured by Gaulin Co., Ltd.) for 360 minutes, and a release agent dispersion (solid content concentration: 20%) formed by dispersing the release agent particles having the volume average particle size of 0.23 μm is prepared.

Example 1

Preparation of Toner

Resin particle dispersion: 350 parts

Release agent dispersion: 48 parts

Metal pigment dispersion 1: 180 parts

Nonionic surfactant (IGEPAL CA897): 1.40 parts

The above raw materials are put in 2 L cylindrical stainless container, dispersed and mixed for 10 minutes while applying a shear force at 4000 rpm using a homogenizer (ULTRA-TURRAX T50 manufactured by IKA Ltd.). Then, 1.75 parts of 10% nitric acid aqueous solution of polyaluminum chloride is gradually added dropwise as an aggregating agent, and the resultant material is dispersed and mixed for 15 minutes by setting a rotating speed of the homogenizer to 5000 rpm, and is set to a raw material dispersion.

After that, the raw material dispersion is put in a polymerization tank including a stirring device using stirring blades of two paddles and a thermometer, heating is started with a mantle heater after setting a stirring rotation speed to 810 rpm, and growth of aggregated particles is promoted at 54° C. At that time, pH of the raw material dispersion is controlled to be in a range of 2.2 to 3.5 with 0.3 N nitric acid and 1 N sodium hydroxide aqueous solution. The raw material dispersion is maintained in the pH range described above for approximately 2 hours and the aggregated particles are formed.

Next, 50 parts of the resin particle dispersion is added and the resin particles of the binder resin are attached to the surface of the aggregated particles. In addition, the temperature thereof is increased to 56° C., and the aggregated particles are prepared while confirming a size and a form of the particles with an optical microscope and a Multisizer II. Then, after increasing pH to 8.0 for coalescing the aggregated particles, the temperature thereof is increased to 67.5° C. After confirming that the aggregated particles are coalesced with the optical microscope, pH thereof is decreased to 6.0 while maintaining the temperature at 67.5° C., the heating is stopped after 1 hour, and cooling is performed at a temperature falling rate of 1.0° C./min. Then, after performing sieving with a mesh of 20 μm and repeating water washing, the resultant material is dried with a vacuum drying machine to obtain toner particles. The volume average particle size of the obtained toner particles is 12.2 μm.

2.0 parts of hydrophobic silica (RY50 manufactured by Nippon Aerosil Co., Ltd.) is mixed with 100 parts of the obtained toner particles using the HENSCHEL mixer at the peripheral speed of 30 m/s for 3 minutes. Then, sieving is performed with a vibration screen with an aperture of 45 μm, to prepare toner.

Measurement

The "content of Zn in toner" is measured by the method described above. The results are shown in Table 1 below.

Preparation of Carrier

Ferrite particles (volume average particle size: 35 μm): 100 parts

Toluene: 14 parts

Perfluoroacrylate copolymer (critical surface tension: 24 dyn/cm): 1.6 parts

Carbon black (product name: VXC-72 manufactured by Cabot Corporation, volume resistivity: 100 Ωcm or lower): 0.12 part Crosslinked melamine resin particles (average particle diameter: 0.3 μm, toluene-insoluble): 0.3 part First, carbon black is diluted with toluene and added to the perfluoroacrylate copolymer and dispersed with a sand mill. Then, each component other than the ferrite particles is dispersed therein with a stirrer for 10 minutes, and a coating layer forming solution is prepared. Then, after putting the coating layer forming solution and the ferrite particles in a vacuum deaeration type kneader and stirring for 30 minutes at a temperature of 60° C., the pressure in the kneader is reduced and toluene is distilled off to form a resin coating layer and obtain a carrier.

Preparation of Developer 36 parts of the toner and 414 parts of the carrier are put in a 2 liter V-blender, stirred for 20 minutes, and then sieved with a mesh of 212 μm to prepare a developer.

Evaluation Test

A solid image is formed with the following method.

A developing device of a DOCUCENTRE-III C7600 manufactured by Fuji Xerox Co., Ltd. is filled with a developer that is a sample, and a solid image having a toner amount of 4.5 g/cm$^2$ is formed on a recording sheet (Rough paper, manufactured by Oji Paper Co., Ltd.) at a fixing temperature of 200° C., a fixing pressure of 4.0 kg/cm$^2$, and a process speed of 220 mm/s.

The solid image is stored in an environment of a temperature of 40° C. and humidity of 85% for 6 months and brilliance of the solid image after storing is evaluated.

Evaluation of Brilliance

The brilliance is visually evaluated with illumination for color observation (natural daylight illumination) based on JIS K5600-4-3:1999 "Testing methods for paints—Part 4: Visual characteristics of film—Section 3: Visual comparison of the color of paints". Granular quality (effect of brilliance to glitter) and optical effects (change of color phase depending on angle) are evaluated with the following criteria. Level 2 and higher levels are levels which may be used practically.

4: Granular quality and optical effects are harmonious

3: Slight granular quality and optical effects

2: Normal quality

1: No granular quality and optical effects

The obtained evaluation results are shown in Table 1.

Examples 2 to 10 and Comparative Examples 1 and 2

Toners are prepared in the same manner as the toner of Example 1 except for using the metallic pigment dispersions shown in Table 1, and the evaluation is performed.

The obtained evaluation results are shown in Table 1.

TABLE 1

| | Metallic pigment dispersion | Content ratio of Zn in toner (%) | Evaluation of brilliance |
|---|---|---|---|
| Example 1 | Metallic pigment dispersion 1 | 0.00009 | 2 |
| Example 2 | Metallic pigment dispersion 2 | 0.00012 | 3 |
| Example 3 | Metallic pigment dispersion 4 | 0.00006 | 2 |
| Example 4 | Metallic pigment dispersion 5 | 0.00047 | 3 |
| Example 5 | Metallic pigment dispersion 6 | 0.00052 | 4 |
| Example 6 | Metallic pigment dispersion 7 | 0.096 | 4 |
| Example 7 | Metallic pigment dispersion 8 | 0.11 | 3 |
| Example 8 | Metallic pigment dispersion 9 | 0.48 | 3 |
| Example 9 | Metallic pigment dispersion 10 | 0.52 | 2 |
| Example 10 | Metallic pigment dispersion 11 | 0.97 | 2 |
| Comparative Example 1 | Metallic pigment dispersion 3 | 0.00004 | 1 |
| Comparative Example 2 | Metallic pigment dispersion 12 | 1.12 | 1 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A brilliant toner comprising;

a metallic pigment; and a binder resin, wherein the metallic pigment contains an aluminum pigment, the surface of which is covered by zinc sulfate, and wherein content of Zn is from 0.00005% by weight to 1.0% by weight based on the weight of the toner.

2. The brilliant toner according to claim 1, wherein the aluminum pigment contains Zn.

3. The brilliant toner according to claim 2, wherein the aluminum pigment is a pigment obtained by mixing aluminum and a zinc-containing compound.

4. The brilliant toner according to claim 2, wherein content of Zn in the aluminum pigment is equal to or less than 5% by weight.

5. The brilliant toner according to claim 1, wherein, when forming a solid image, a ratio (A/B) of a reflectance A at a light-receiving angle of +30° and a reflectance B at a light-receiving angle of −30° which are measured when incident light at an angle of incidence of −45° is radiated with respect to the solid image by using a goniophotometer, is from 50 to 100.

6. The brilliant toner according to claim 1, wherein an average equivalent circle diameter D of toner particles is longer than an average maximum thickness C thereof.

7. The brilliant toner according to claim 6, wherein a ratio (C/D) of the average maximum thickness C to the average equivalent circle diameter D is from 0.001 to 0.500.

8. The brilliant toner according to claim 1, wherein, when cross sections of toner particles in a thickness direction are observed, the number of metallic pigment particles that are present in which an angle between a long axis direction of the toner particles in the cross section and a long axis direction of the metallic pigment particles is from −30° to +30° is 60% or greater of the total number of metallic pigment particles that are observed.

9. The brilliant toner according to claim 1, wherein content of the metallic pigment is from 1 part by weight to 70 parts by weight, with respect to 100 parts by weight of the binder resin.

10. The brilliant toner according to claim 1, wherein the binder resin is a polyester resin.

11. The brilliant toner according to claim 10, wherein a glass transition temperature (Tg) of the polyester resin is from 50° C. to 80° C.

12. The brilliant toner according to claim 10, wherein the weight average molecular weight (Mw) of the polyester resin is from 5,000 to 1,000,000.

13. The brilliant toner according to claim 10, wherein the molecular weight distribution Mw/Mn of the polyester resin is from 1.5 to 100.

14. The brilliant toner according to claim 1, further containing a release agent, wherein a melting temperature of the release agent is from 50° C. to 110° C.

15. An electrostatic charge image developer containing the brilliant toner according to claim 1.

16. The electrostatic charge image developer according to claim 15, further containing a carrier, wherein the carrier is a coated carrier in which surfaces of magnetic powder are coated with a coating resin.

17. The electrostatic charge image developer according to claim 16, wherein the coating resin contains a conductive material.

* * * * *